US006341764B1

(12) United States Patent
Conner

(10) Patent No.: US 6,341,764 B1
(45) Date of Patent: Jan. 29, 2002

(54) FENCE SYSTEM

(75) Inventor: John P. Conner, Grandville, MI (US)

(73) Assignee: Allied Tubing & Conduit Corporation, Harvey, IL (US)

( * ) Notice: Subject to any disclaimer, the term of this patent is extended or adjusted under 35 U.S.C. 154(b) by 0 days.

(21) Appl. No.: 09/552,940

(22) Filed: Apr. 20, 2000

Related U.S. Application Data

(60) Provisional application No. 60/155,368, filed on Nov. 19, 1999, and provisional application No. 60/130,448, filed on Apr. 20, 1999.

(51) Int. Cl.[7] ..... H01L 29/04
(52) U.S. Cl. ..... 256/65; 256/19; 256/59
(58) Field of Search ..... 256/70, 19, 21, 256/22, 59, 65, 68, 66

(56) References Cited

U.S. PATENT DOCUMENTS

| | | | | |
|---|---|---|---|---|
| 189,543 A | | 4/1877 | Van Dorn | |
| 261,281 A | * | 7/1882 | Van Dorn | 256/70 |
| 3,174,727 A | | 9/1962 | Burt et al. | |
| 3,258,251 A | | 6/1966 | Culter | |
| 3,372,909 A | | 3/1968 | Attaway | |
| 3,516,644 A | | 6/1970 | Horgan, Jr. | |
| 3,529,808 A | | 9/1970 | Siebers | |
| 3,648,982 A | | 3/1972 | Sabel et al. | |
| 4,125,249 A | | 11/1978 | Zen | |
| 4,193,229 A | | 3/1980 | Hartman | |
| 4,361,314 A | * | 11/1982 | Ohlson | 256/45 |
| 5,150,885 A | | 9/1992 | Leone | |
| 5,372,354 A | | 12/1994 | Cacicedo | |
| 5,575,580 A | | 11/1996 | Parrish et al. | |
| 5,785,447 A | * | 7/1998 | Fonti et al. | 256/65 |

* cited by examiner

*Primary Examiner*—Lynne H. Browne
*Assistant Examiner*—A. Dunwoody
(74) *Attorney, Agent, or Firm*—Banner & Witcoff, Ltd.

(57) ABSTRACT

An improved picket fence system is disclosed comprising a plurality of vertical posts, a plurality of rails mounted to the posts, and a plurality of pickets pivotally mounted to the plurality of rails. The pickets are pivotally mounted to the rails through the use of a unique grommet assembly that is snap-fitted onto the pickets and is seated in an aperture in the rail. The grommet, which defines a pivot pin, permits the picket to pivot about the pivot pin and thus relative to the rail, thereby providing a unique fence system that may be installed on either a level grade or an incline with minimal, if any, tooling.

11 Claims, 4 Drawing Sheets

22
20
26
30
24
14
20

30
22
32
14
28

10
14
12
16

12

16
34

32
32
14

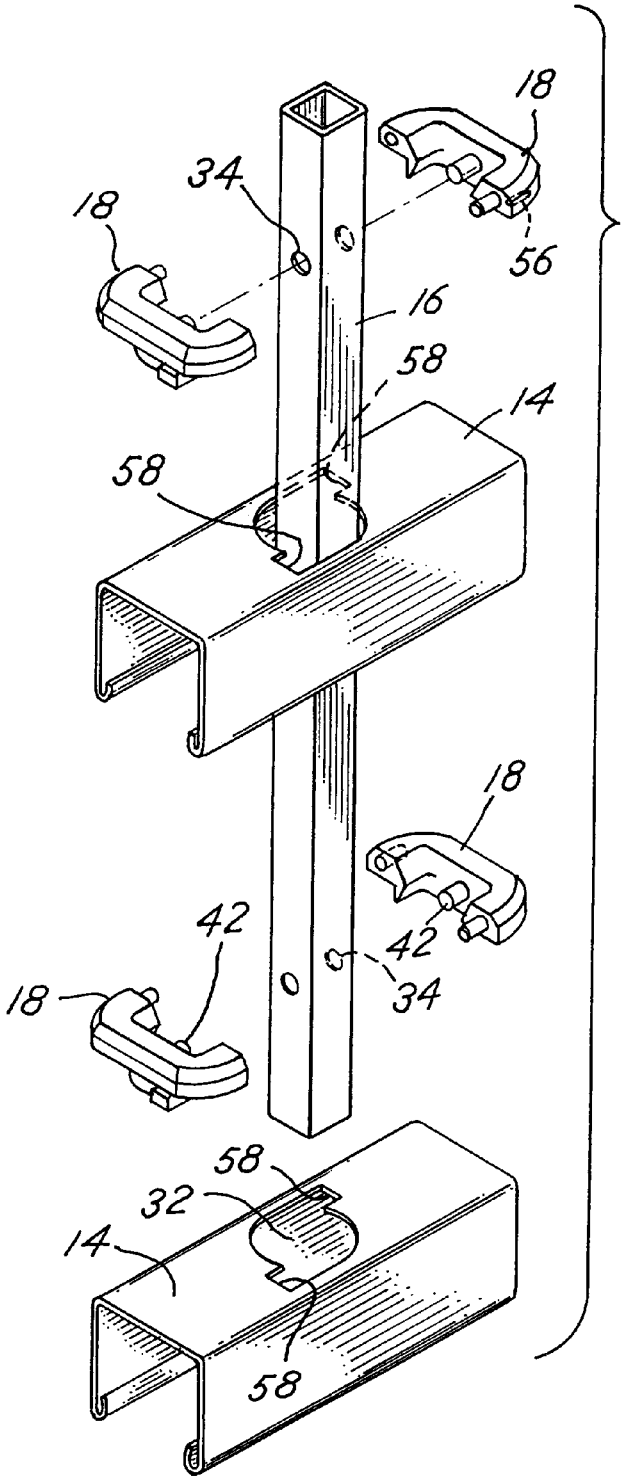
FIG.7
FIG.8
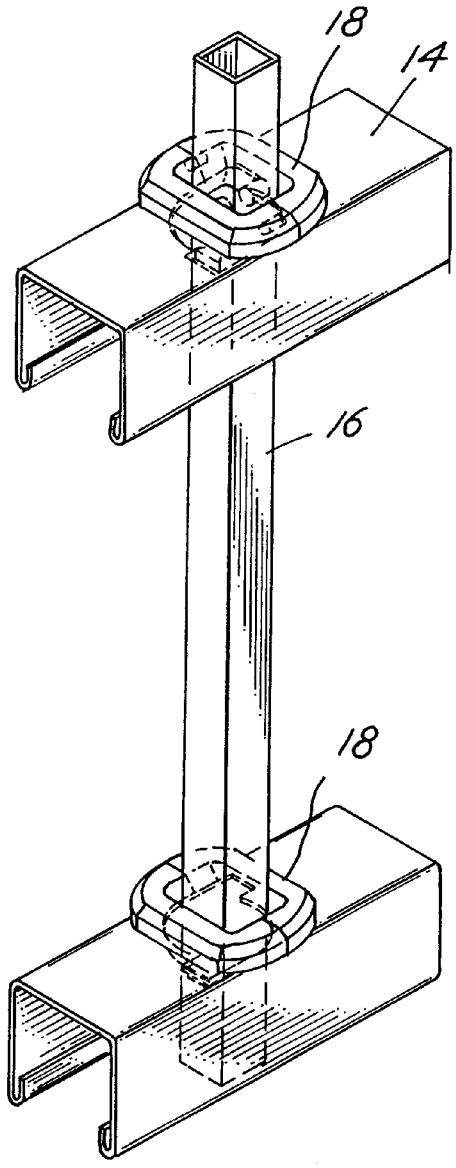

FENCE SYSTEM

This application claims the benefit of priority of U.S. Provisional Application Nos. 60/130,448, filed Apr. 20, 1999 and 60/155,368, filed Nov. 19, 1999.

BACKGROUND OF THE INVENTION

1. Field of Invention

The present invention relates in general to fence systems. More specifically, but without restriction to the particular use which is shown and described, this invention relates to an improved ornamental fence system incorporating pivotal pickets which are easily assembled to the rails.

2. Description of the Related Art

The manufacture and assembly of ornamental and security fence systems has been gradually improved upon in the prior art. However, there still remains a need for improved picket fence systems that are mountable on level grades or on inclines, where the pickets need to pivot relative to the rails. Moreover, there is always a need for picket fence systems that are easily installed with minimal parts and tooling. For example, Van Dorn, U.S. Pat. No. 189,543 discloses an early picket fence system having pickets which are installed through openings in the rails and then rotated 90 degrees to lock the picket to the rail. Leone, U.S. Pat. No. 5,150,885 teaches an improvement of the rotating and locking pickets disclosed in Van Dorn. Both of these fence systems, however, are rigid structures and thus are not desirable to install on inclines or non-level grades. Other fence systems are known that provide pickets which pivot relative to the rails. For instance, Attaway, U.S. Pat. No. 3,372,909, Horgan, U.S. Pat. No. 3,516,644, Sabel, U.S. Pat. No. 3,648,982, and Zen, U.S. Pat. No. 4,125,249 disclose pickets that are pivotal relative to the rails through the use of hinges and pins. These known picket fence systems, however, require significant tooling and are not readily and easily installed. Thus, there remains a need in the art for improved fence systems that are easier to assemble, result in greater flexibility in installation and are mountable on either level grades or inclines depending on the desired application.

SUMMARY OF THE INVENTION

Accordingly, an object of the present invention is to overcome the known disadvantages of existing picket fence systems. It is a further object to provide a picket fence system that is easily mountable on an incline or a level grade. It is still a further object of the present invention to provide a picket fence system that may be easily installed with minimal tooling and parts.

Briefly, in summary, the present invention comprises a plurality of anchoring posts, a plurality of rails pivotally mounted to the plurality of posts, and a plurality of pickets pivotally mounted to the plurality of rails. To permit pivotal movement of the pickets relative to the rails, a unique grommet is used to mount the pickets to the rails. This unique grommet for fence systems comprises the snap-fitting of two C-shaped grommet pieces, each having a pivot pin, into a pair of opposing holes formed in the square tube pickets. The grommet, which defines a flange, a groove, and an anti-reverse lug, is then installed into an aperture formed in the rail. The picket is rotated 90 degrees with the top wall of the rail passing through the groove. The picket is locked in position via the flange and anti-reverse lug which prevent both vertical movement and reverse rotation of the picket. As installed, the grommet and accompanying rail are pivotally connected to the picket, thereby permitting pivotal movement of the picket relative to the rail. The assembly of the inventive picket fence system is accomplished with minimal, if any, tooling.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWINGS

The preferred embodiments of the invention will be described in relation to the accompanying drawings. In the drawings, the following figures have the following general nature:

FIG. 7 is an enlarged assembly view of the picket and rail assembly of the present invention.

FIG. 8 is an assembled view of the invention of FIG. 7.

In the accompanying drawings, like reference numbers are used throughout the various figures for identical structures.

DESCRIPTION OF THE PREFERRED EMBODIMENTS

Figures 1, 2, 3, 4, 5, 6:
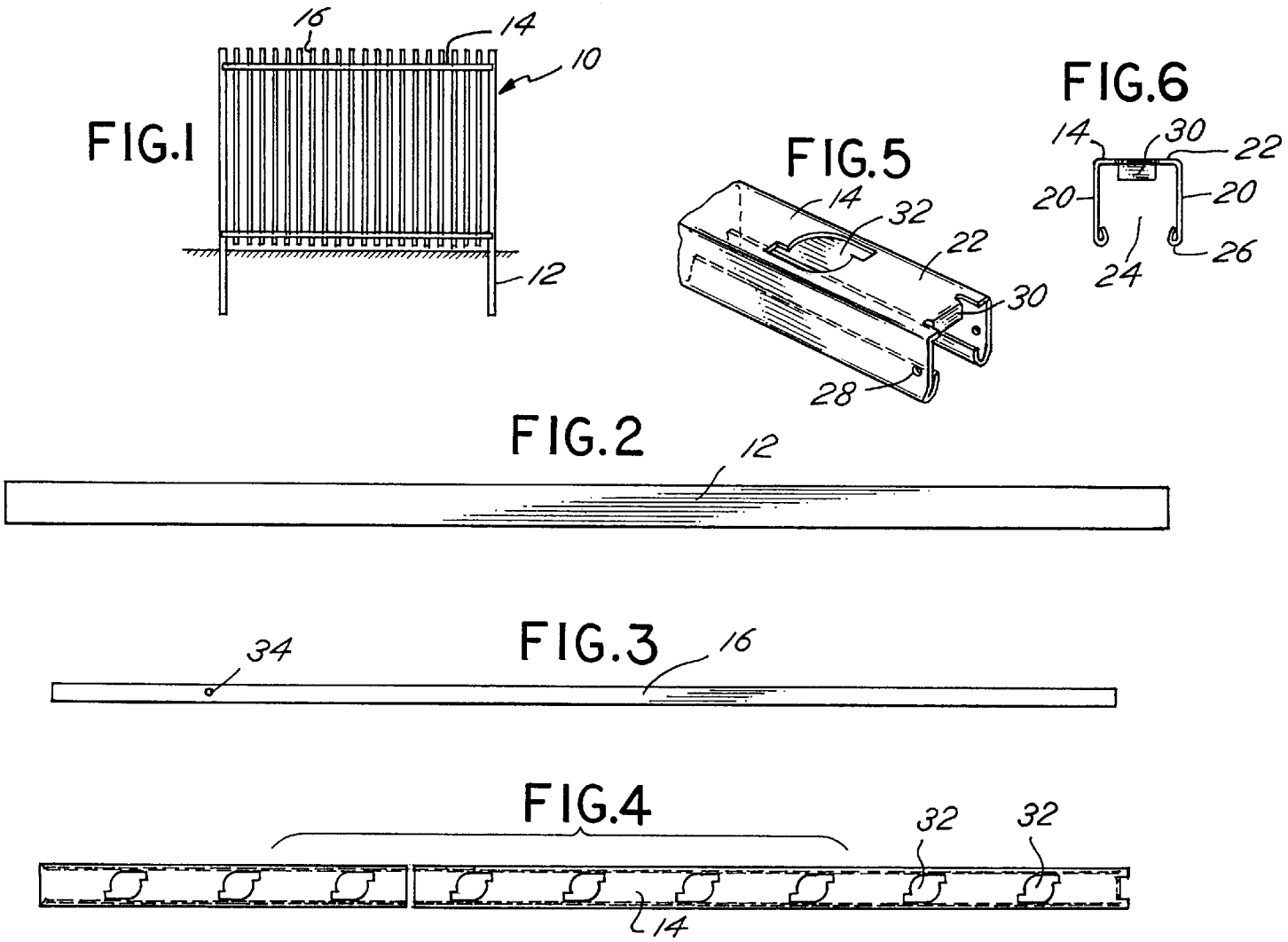
FIG. 1 is a side view of the fence system of the present invention.
FIG. 2 is a side view of the post of the invention of FIG. 1.
FIG. 3 is a side view of the picket of the invention of FIG. 1.
FIG. 4 is a plan view of the rail of the invention of FIG. 1.
FIG. 5 is an isometric view of the rail of FIG. 4.
FIG. 6 is an end view of the rail of FIG. 4.

Referring to FIG. 1, there is disclosed a preferred embodiment of the picket fence assembly 10 of the present invention. The fence assembly 10 includes generally a plurality of spaced-apart vertical posts 12, a plurality of horizontal rails 14 pivotally mounted to the posts, and a plurality of vertical pickets 16 pivotally mounted to the rails. As illustrated in FIGS. 7–10, the pickets 16 are preferably mounted to the rails 14 through the use of grommets 18 which hold the pickets to the rails and permit pivotal movement of the pickets relative to the rails.

As depicted in FIG. 2, the posts 12 are made from conventional square tubing having a uniform cross-section. The size, thickness, length and material of the posts may vary depending on the desired application.

With respect to the rails 14, two rails 14 are preferred and are positioned near the top and bottom of the fence system. The rails 14 are identical, each having a generally U-shaped cross-section, as illustrated in FIGS. 4–6. That is, in cross-section, each rail has opposing side walls 20, a top wall 22, and an opening 24 at the bottom. At each end of the rail, on the side walls are holes 28 which permit the mounting of the rails 14 to the posts 12. A tab 30 may also be formed on the top wall 22 at one or both ends of the rail to further assist in the mounting of the rail to the post. The bottom of the side walls 20 is rounded at 26 to eliminate sharp edges on the rail. The top wall 22 further defines a plurality of apertures or openings 32 which are spaced equidistant along the length of the rail. The apertures 32 are generally S-shaped and receive the grommets 18, as depicted in FIG. 8. The shape of the apertures permit the grommets to be rotated and locked onto the rails. Note that other shapes of apertures 32 may be used provided the grommets are secured to the rails.

Referring to FIG. 3, the pickets 16 are made from conventional square tubing having a uniform cross-section. Again, the size, thickness, length, and material of the pickets may vary depending on the desired application. Each picket 16 includes a pair of holes 34 which extend through opposing walls of the picket to receive the pivot pin 42 of the grommet 18, more fully discussed below. Significantly, through the use of the rail-mounted grommet, accompanying grommet pivot pin, and the holes 34, each picket is permitted to pivot about the hole 34 and thus relative to the grommet and rail. As a result of this pivotal movement, the inventive picket fence system may be used on level grades or inclines.

Referring to FIGS. 7–14, there is depicted various views of the grommet 18 of the present invention. The grommet 18 may be made from glass-filled nylon or other suitable material. As depicted and preferred, the grommet 18 defines identical grommet halves, which when installed, are snap-fitted or press-fitted to each other. Each grommet half is generally C-shaped and defines an integral dowel 38 and a bore 40. As installed, the dowel 38 of a first grommet half is aligned with and inserted into the bore 40 of a second grommet half. Likewise, the dowel 38 of the second grommet half is aligned with and inserted into the bore 40 of the first grommet half. The resulting assembly is the one-piece grommet 18 depicted in FIGS. 8–10. The grommet further defines a pivot pin 42 which is centrally located on the grommet body and protrudes outward from the grommet. As shown in FIGS. 7–8, the grommet 18 defines a pair of opposing pivot pins 42 which are inserted into the opposing holes 34 located in the pickets 16. The pivot pins 42 permit the pivotal movement of the grommet and accompanying rail relative to the picket.

Returning to FIGS. 11–14, each grommet half also defines a downwardly extending radial boss 44 and a flange 46 which extends radially outward from the boss 44. A groove 48 is formed between the flange 46 and the bottom surface 50 of the grommet. The flange 46 defines a chamfer 52 and a contact surface 54. As preferred, an anti-reverse lug 56 protrudes outward from the bottom surface 50 of the grommet. The anti-reverse lug 56 prevents the reverse rotation of the grommet after the grommet is seated in the aperture on the rail. Note that the lug 56 may be positioned at other locations on the grommet and through friction forces between the lug and the rail, for example, still prevent reverse rotation of the grommet. Furthermore, other means of preventing reverse rotation of the grommet may be used and still be considered within the scope of the present invention.

Figure 9:
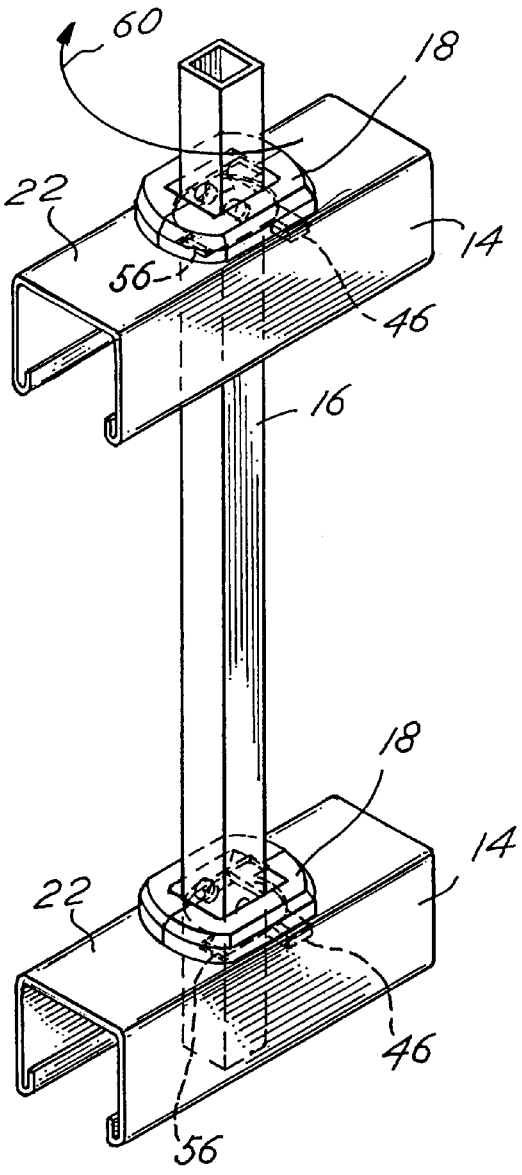
FIG. 9 is an assembled view of the invention of FIG. 8 after the picket has been rotated 90 degrees.
Figure 10:
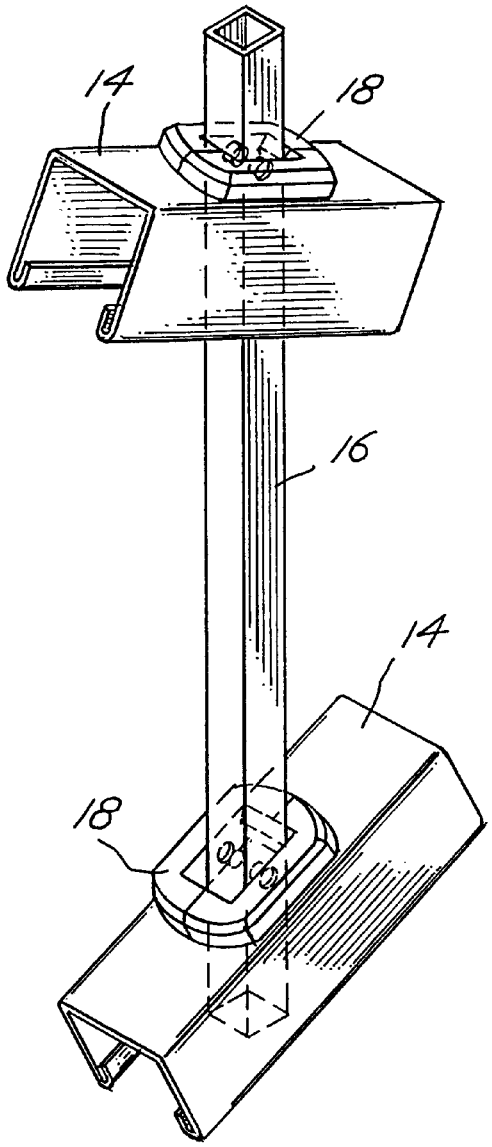
FIG. 10 is an assembled view of the invention of FIG. 9 illustrating the pivotal movement of the rail relative to the picket.
Figure 11:
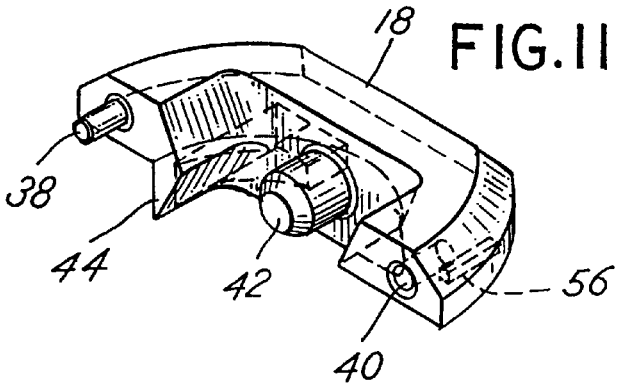
FIG. 11 is an isometric view of the grommet of the invention of FIG. 7.
Figure 12:
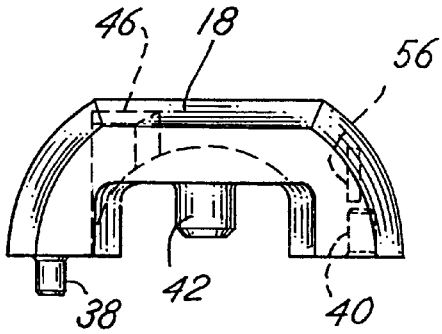
FIG. 12 is a plan view of the grommet of FIG. 11.
Figure 13:
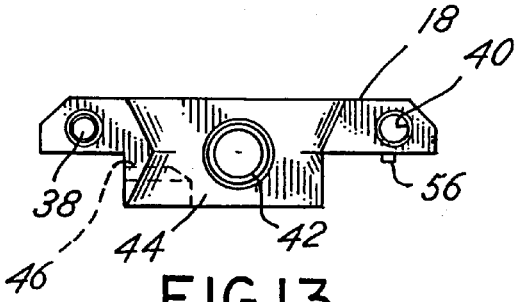
FIG. 13 is a side view of the grommet of FIG. 11.
Figure 14:
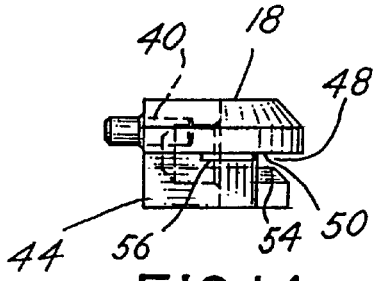
FIG. 14 is an end view of the grommet of FIG. 11.

Referring to FIG. 7, to assemble the fence system of the present invention, the pivot pins 42 of the grommet 18 halves are inserted into the associated holes 34 of the pickets 16. The grommet halves are then either snap-fitted or press fitted together. As assembled, the resulting one-piece grommet 18 pivots about the holes 34 of the picket 16. Typically, two grommets are assembled onto each picket as illustrated in the figures. Referring to FIG. 8, after the grommets are installed, the picket and accompanying grommets are lowered into the S-shaped apertures 32 in the rails 14. The grommets are lowered until the boss 44 and flange 46 pass through the apertures 32 and the bottom surface 50 of the grommet contacts the top wall 22 of the rail 14. Referring to FIG. 9, the picket is then rotated 90 degrees clockwise, as indicated by direction line 60 with the flange of the grommet passing below the top wall 22 of the rail. As the grommet completes its 90 degree rotation, the anti-reverse lug travels over the S-shaped aperture 32 and snaps into the aperture at 58. Advantageously, the flange 46, now located below the top wall 22 of the rail, prevents vertical movement of the picket and the anti-reverse lug 56 now snap-fitted into the aperture at 58 prevents the reverse rotation of the grommet after it is assembled. As exemplified by FIG. 10, the mounted rails seated on the grommet 18 may be pivoted relative to the pickets. The rails are pivotal relative to the pickets because the pivot pins of the grommet are perpendicular to the side walls 20 of the rails. While a large pivot range of the rail relative to the picket is achievable by the present invention, it is preferred that the pivot range be approximately 50 degrees, or 25 degrees above and below a horizontal plane.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A fence system comprising:

a plurality of posts, at least one rail mounted to the plurality of posts, the rail having a plurality of apertures, a plurality of vertically disposed pickets each passing through one of the apertures, the pickets defining opposing openings, a grommet pivotally mounted to each of the pickets, the grommet defining a flange, a groove, and a central pivot pin, the flange and the groove for mounting the picket to the rail at the aperture, the groove permitting rotation of the picket relative to the rail, the flange preventing vertical movement of the picket relative to the rail, and the central pivot pin for engaging the opposing openings and permitting pivotal movement with the picket.

2. The fence system of claim 1 wherein the grommet further defines a lug that prevents reverse rotation of the picket relative to the rail.

3. The fence system of claim 1 wherein the grommet defines a pair of grommet halves removably engaged together.

4. A fence system comprising:

a plurality of posts, a plurality of rails pivotally mounted to the plurality of posts, the rails defining a plurality of apertures for receiving a grommet, a plurality of vertically disposed pickets each passing through one of the apertures, each picket defining an opening, the grommet defining a central pivot pin for engagement with the opening and permitting pivotal movement with the picket and a means for preventing reverse rotation of the picket relative to the rail, the grommet pivotally mounted to the picket and rotatably mounted to the rail at the aperture.

5. The fence system of claim 4 wherein the grommet defines a pair of grommet halves removably engaged together.

6. The fence system of claim 4 wherein the means for preventing reverse rotation of the picket is a lug extending outward from the grommet.

7. The fence system of claim 6 wherein the grommet further defines a pair of grommet halves removably engaged together.

8. The fence system of claim 7 wherein the grommet further defines a flange that prevents vertical movement of the picket relative to the rail.

9. The fence system of claim 4 wherein the grommet defines a flange that prevents vertical movement of the picket relative to the rail.

10. A fence system comprising:

a plurality of posts, a plurality of rails pivotally mounted to the plurality of posts, the rails defining a plurality of apertures for receiving a grommet, a plurality of vertically disposed pickets each passing through one of the apertures, the pickets defining opposing holes for receiving pivot pins of the grommet, the grommet defining a flange and lug for mounting the picket to the rail at the aperture, the flange preventing vertical movement and the lug preventing reverse rotation of the picket relative to the rail.

11. The fence system of claim 10 wherein the grommet defines a pair of grommet halves removably engaged together.

* * * * *